United States Patent [19]

Wanalista

[11] Patent Number: 5,067,730

[45] Date of Patent: Nov. 26, 1991

[54] SPORTS GAME ORGANIZATION

[76] Inventor: Charles Wanalista, 749 Main St., Avoca, Pa. 18641

[21] Appl. No.: 668,043

[22] Filed: Mar. 12, 1991

[51] Int. Cl.[5] ..... A63B 67/00; A63B 65/00

[52] U.S. Cl. ..... 273/411; 273/400; 273/428

[58] Field of Search ..... 273/411, 415, 427, 428, 273/400, 341, 389

[56] References Cited

U.S. PATENT DOCUMENTS

| | | | |
|---|---|---|---|
| 712,159 | 10/1902 | Voege | 273/400 |
| 2,506,815 | 5/1950 | Shaffer | 273/415 |
| 2,993,696 | 7/1961 | Demaline | 273/341 X |
| 3,024,024 | 3/1962 | Chalcroft | 273/411 |
| 3,163,421 | 12/1964 | Matyko | 273/415 |
| 3,749,401 | 7/1973 | Hayko | 273/389 |
| 3,822,063 | 7/1974 | Rea | 273/400 |
| 3,861,683 | 1/1975 | Henry | 273/428 |
| 4,149,724 | 4/1979 | Walsh | 273/341 |
| 4,317,571 | 3/1982 | Vrcic | 273/341 |

*Primary Examiner*—William H. Grieb

*Attorney, Agent, or Firm*—Leon Gilden

[57] ABSTRACT

A plurality of teams, including at least two players for each team, are directed to opposing containers of the apparatus, wherein one player of each team positions a bat member within a first container, wherein a defending team directs a tubular projectile towards the opposing container, wherein a player with a bat is directed to strike the projectile, or alternatively faced towards the opposing container and position the bat member within the opposing container to score points thereby.

3 Claims, 4 Drawing Sheets

SPORTS GAME ORGANIZATION

BACKGROUND OF THE INVENTION

1. Field of the Invention

The field of invention relates to sporting event type games, and more particularly pertains to a new and improved sports game organization wherein the same is arranged to effect scoring by directing running of players from one container to an opposing container in positioning a bat member therein to effect scoring of points.

2. Description of the Prior Art

Pitching type games of various categories have been utilized in the prior art, wherein opposing players attempt to direct a projectile into an opposing player's support. The instant invention attempts to overcome deficiencies of the prior art by enhancing need for mobility and adroitness in hand/eye coordination, as well as in speed to effect scoring of points. Examples of prior art in this category may be found for example in U.S. Pat. No. 712,159 to Vogue wherein a game apparatus is provided wherein a single container is provided to receive projectiles from opposing players.

U.S Pat. No. 3,822,063 to Rea sets forth a target for use in receiving a projectile, wherein the target includes a central cup member in a surrounding hood organization.

U.S. Pat. No. 3,749,401 to Hayko wherein a tic-tac-toe apparatus is provided with pockets for receiving various projectiles therewithin.

As such, it may be appreciated that there continues to be a need for a new and improved sports game organization as set forth by the instant invention which addresses both the problems of ease of play as well as enhancing athletic skill and ability and in this respect, the present invention substantially fulfills this need.

SUMMARY OF THE INVENTION

In view of the foregoing disadvantages inherent in the known types of sporting and pitching games now present in the prior art, the present invention provides a sports game organization wherein the same is arranged to direct a batting player to run to a defending team's container to enhance activity in use of the game in scoring of points thereby. As such, the general purpose of the present invention, which will be described subsequently in greater detail, is to provide a new and improved sports game organization which has all the advantages of the prior art batting games and none of the disadvantages.

To attain this, the present invention provides a plurality of teams, including at least two players for each team, are directed to opposing containers of the apparatus, wherein one player of each team positions a bat member within a first container, wherein a defending team directs a tubular projectile towards the opposing container, wherein a player with a bat is directed to strike the projectile, or alternatively faced towards the opposing container and position the bat member within the opposing container to score points thereby.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sports game organization which has all the advantages of the prior art batting games and none of the disadvantages.

It is another object of the present invention to provide a new and improved sports game organization which may be easily and efficiently manufactured and marketed.

It is a further object of the present invention to provide a new and improved sports game organization which is of a durable and reliable construction.

An even further object of the present invention is to provide a new and improved sports game organization which is susceptible of a low cost of manufacture with regard to both materials and labor, and which accordingly is then susceptible of low prices of sale to the consuming public, thereby making such sports game organizations economically available to the buying public.

Still yet another object of the present invention is to provide a new and improved sports game organization which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
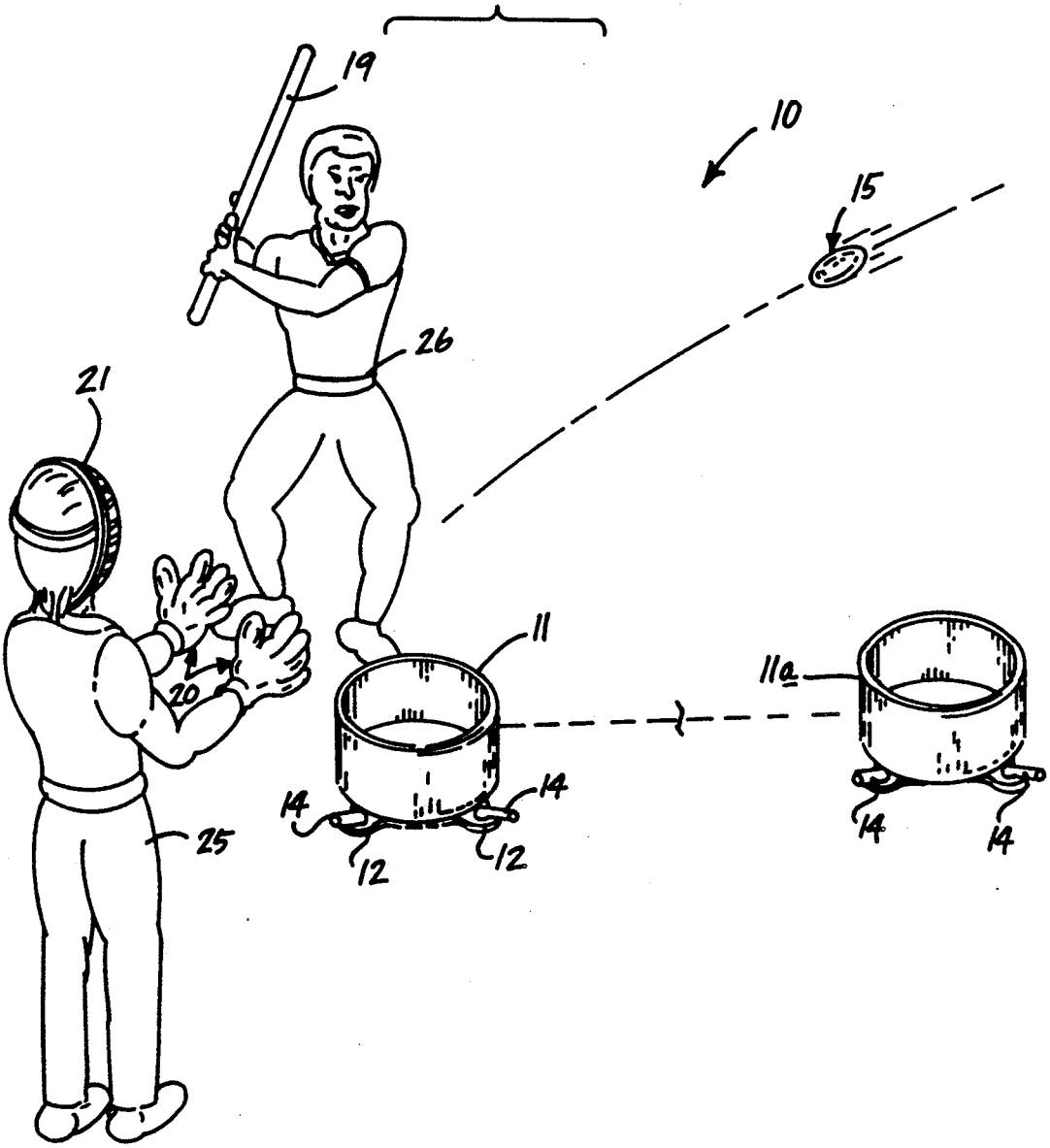
FIG. 1 is an isometric illustration of the instant invention directing a batting team to hit an incoming projectile towards an opposing team's container.
Figure 2:
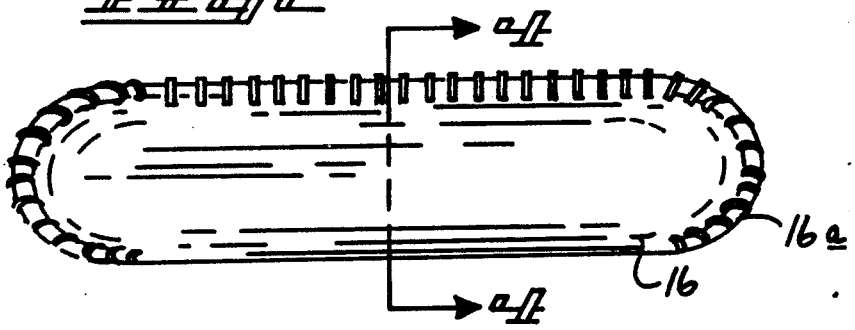
FIG. 2 is an orthographic side view of the projectile of the instant invention.
Figure 3:
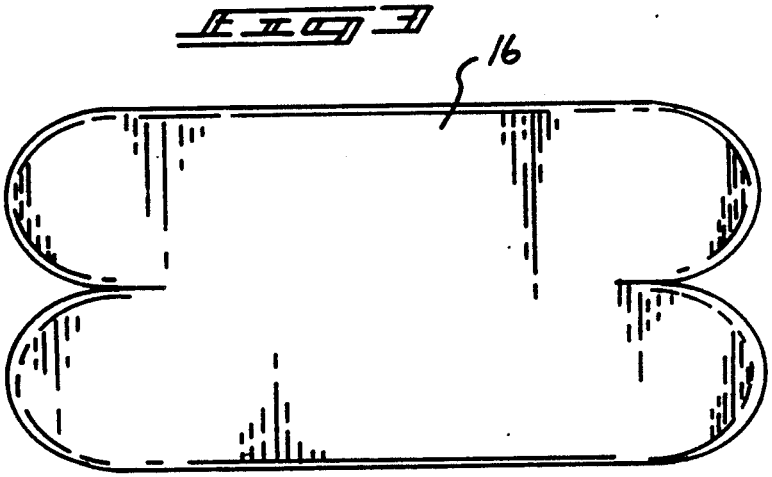
FIG. 3 is a top orthographic view of the projectile in an open configuration prior to depositing material therewithin.
Figure 4:
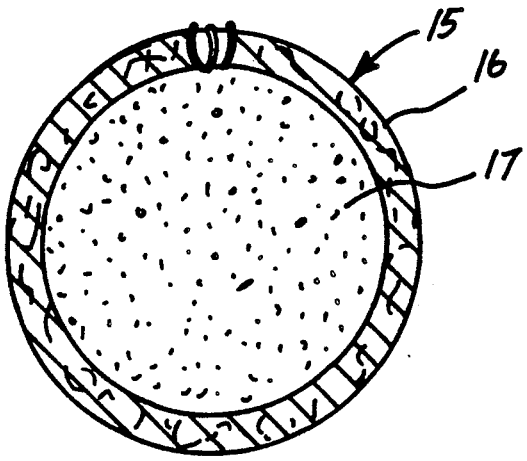
FIG. 4 is an orthographic view, taken along the lines 4—4 of FIG. 2 in the direction indicated by the arrows.
Figure 5:
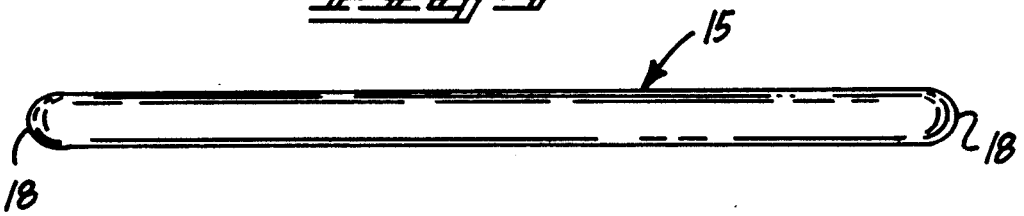
FIG. 5 is an orthographic side view of the projectile in an assembled configuration.

With reference now to the drawings, and in particular to FIGS. 1 to 9 thereof, a new and improved sports game organization embodying the principles and concepts of the present invention and generally designated by the reference numeral 10 will be described.

Figure 6:
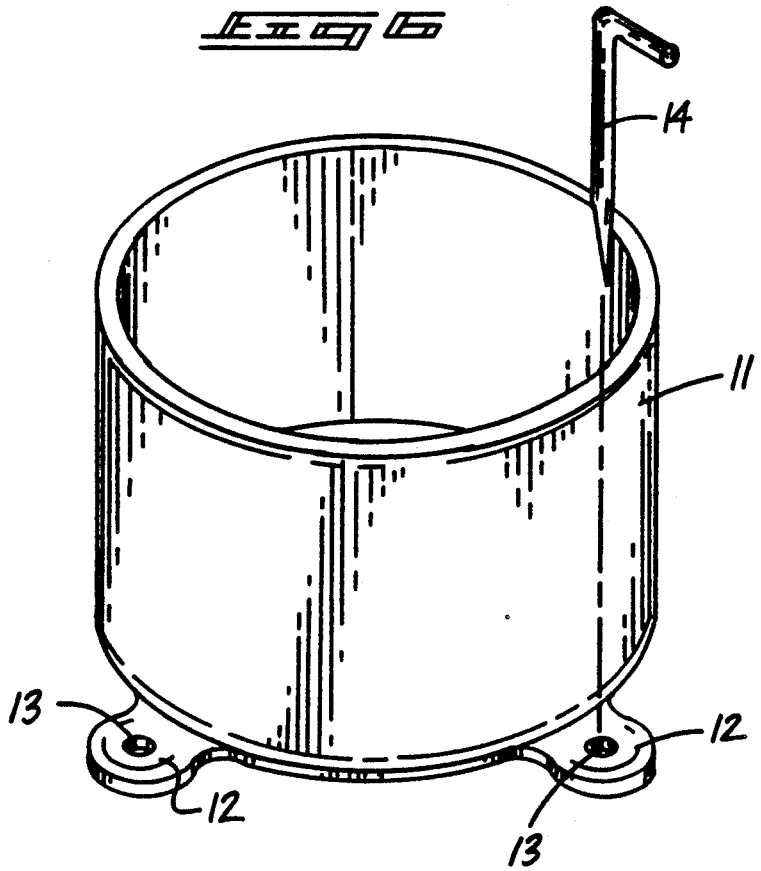
FIG. 6 is an isometric illustration of a typical container utilized by each team of the instant invention.
Figure 7:
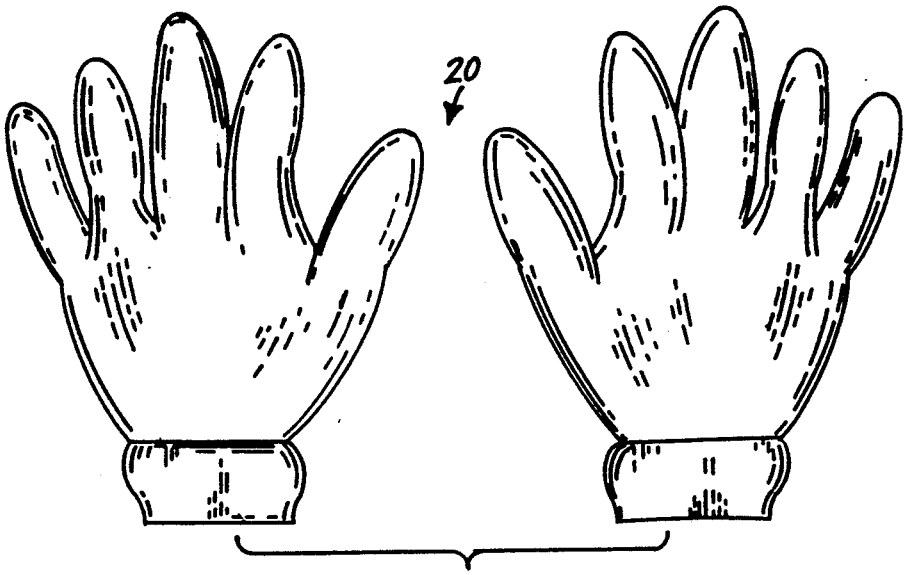
FIG. 7 is a top orthographic view of the glove members utilized by each team.
Figure 8:
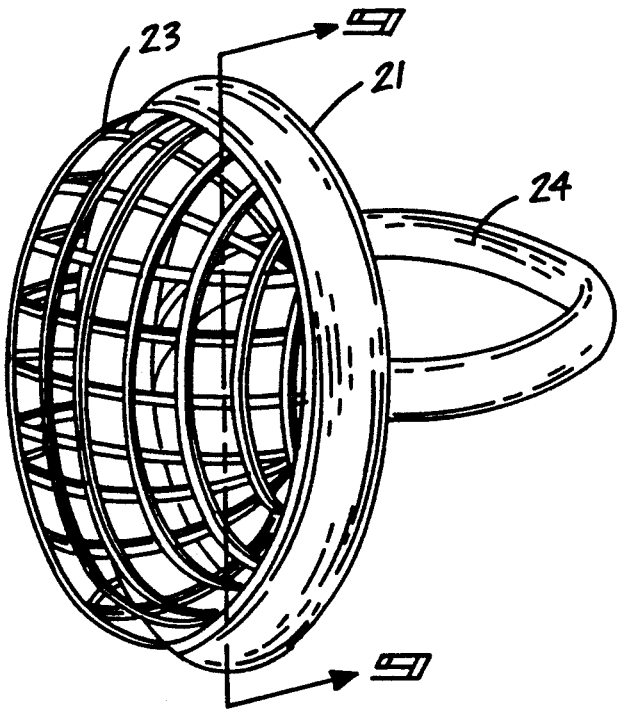
FIG. 8 is an isometric illustration of the mask structure utilized by each team
Figure 9:
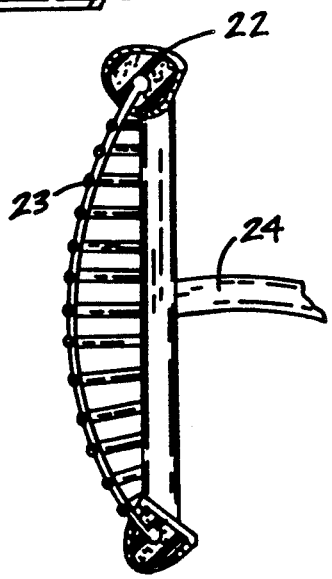
FIG. 9 is an orthographic view, taken along the lines 9—9 of FIG. 8 in the direction indicated by the arrows.

More specifically, the sports game organization 10 defining the instant invention includes apparatus depicted in the FIGS. 1–9 to include a plurality of container members defined by a first container member 11 and a second container member 11*a*. Each of the containers includes plurality of support legs 12 mounted to a bottom surface of each container member, with each of the support legs 12 including an aperture 13 directed therethrough to receive in each aperture an "L" shaped securement pin 14, in a manner as illustrated in FIG. 6, to securely affix each container member in a predetermined orientation relative to one another. A tubular projectile 15, including a flexible covering skin 16 and secured together by stitching 16*a* and filled with a granular or dust-like filler interior 17 of a dry material to provide for a gyratory flight when impacted by a bat member 19 provided each team. The tubular projectile 15 is formed with semi-spherical end portions 18 to encase the interior filling therewithin. The bat members 19 are each formed with an upper and lower terminal end.

Each team of a plurality of teams is provided with a first player and a second player 25 and 26 respectively. The first player 25 is provided with a glove pair 20 of flexible construction and a protective face mask 21. The protective face mask 21 is formed with a foam elliptical perimeter guard 22, with a mesh convex grid 23 directed interiorly of the guard 22. A head band 24 mounted to the guard 22 secures the face mask to an individual's head, as illustrated in FIG. 1 for example. In use, each team is provided with a bat member 19, a plurality of gloves 20, a mask 21, and a container member. A single projectile 15 is utilized.

Arbitrarily, a defensive team is chosen with an opposing team formed as a batting team. Such selection may utilize various arbitrative manner such as dice, a coin flip, and the like. The containers 11 and 11*a* are spaced apart a predetermined spacing, wherein such spacing may be of a desired length such as 20 to 40 feet. The second player 26 of the batting team is positioned adjacent the first container member 11, with the bat positioned with a terminal end of the bat contained within the container 11. The opposing or defensive team is positioned in the identical configuration, wherein the first player 25 of each team alternates as a catcher and a pitcher in either catching or throwing the projectile 15 to an opposing container.

In scoring of points, the second player of each team may either hit the projectile 15 where a point is scored upon the hitting player racing to an opposing container member and positioning a terminal end of the bat member 19 within the opposing container, with the terminal end of the bat touching an interior surface of an opposing container member. Each time containers are switched by a batting player touching an opposing an interior surface of an opposing player's container, the containers are switched and a point is scored. In lieu of striking the projectile 15, the batter may race to an opposing container and position the terminal end of the bat within the opposing container whether the projectile is swung at or not. It should be noted that at any time the projectile 15 is directed within the container 11 by a pitching team and the batting team fails to have a terminal end of the bat within the batting team's container, an automatic out is awarded. If the projectile is struck in the air and caught by a defensive player of a defensive team, that batter is out and teams switch positions. Striking of the projectile a long distance beyond the defensive team may permit awarding of a greater number of points in excess of one, to be arbitrarily decided, such as five points. An alternative manner of playing the game employs the first player 25 being of an opposing team and the second player 26 being of the batting team, whereupon at any moment, the batting team's player 26 does not have a terminal end of the bat within the container adjacent that batter, the defending team's player 25 may merely drop the projectile within the container adjacent the batter to effect an "out". In this orientation of defensive and offensive players, with the defensive player behind the associated container and an offensive player adjacent the container, the defensive pitcher, such as in FIG. 1 (not shown), will continue to throw the projectile until an "out" is awarded and the roll reversals are effected, wherein the opposing or second container 11*a* is provided with the defending team batting and initial offensive team or batting team catching. It is understood that the second method of play of the game employs a batting team's player throwing the projectile and the batting team's member 26 attempting to strike the projectile.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A method of playing a sports game comprising the steps of, providing a first container and a second container, each container including a plurality of leg members, and each leg member of the plurality of leg members including a through-extending aperture therethrough, and a plurality of securement pins, and a securement pin of the plurality of securement pins directed through each aperture of each of the support legs, and securing the first container and the second container at a predetermined spacing relative to one another, and providing a tubular projectile, with the tubular projectile formed with a flexible covering skin and an interior granular material to effect gyratory flight of the projectile when impacted, and a plurality of bat members, and a plurality of teams, and each team formed with a plurality of players, and providing each of the teams with a bat member, and designating a first team with a first player the first team positioned behind the second container member, and the second player of the first team positioned adjacent the first container, and providing the second player with the bat member, and positioning the first player of the second team behind the first container member adjacent the second player of the first team.

2. A method as set forth in claim 1 wherein the second player of the first team initially positions the bat member within the first container member, and the first player of the first team throws the projectile towards the second member of the first team.

3. A method as set forth in claim 2 wherein the second player of the first team attempts to strike the projectile, or alternatively races towards the second container member to position the bat member within the second container member and effect contiguous communication between the bat member and an interior surface of the second container member prior to the first player of the second team depositing the projectile within the first container member.

* * * * *